US011460018B2

(12) United States Patent
Brunson, Jr.

(10) Patent No.: US 11,460,018 B2
(45) Date of Patent: Oct. 4, 2022

(54) SYSTEMS AND METHODS FOR ATTENUATING SOUND

(71) Applicant: EnQuest Energy Solutions, LLC, Houston, TX (US)

(72) Inventor: Weldon Edward Brunson, Jr., Nacogdoches, TX (US)

(73) Assignee: Enquest Energy Solutions, LLC, Houston, TX (US)

( * ) Notice: Subject to any disclaimer, the term of this patent is extended or adjusted under 35 U.S.C. 154(b) by 572 days.

(21) Appl. No.: 16/550,952

(22) Filed: Sep. 6, 2019

(65) Prior Publication Data

US 2021/0071654 A1 Mar. 11, 2021

(51) Int. Cl.
*F04B 39/00* (2006.01)
*G10K 11/168* (2006.01)

(52) U.S. Cl.
CPC ..... *F04B 39/0033* (2013.01); *G10K 11/168* (2013.01)

(58) Field of Classification Search
CPC . G10K 11/162; G10K 11/168; F04B 39/0033; G01V 1/09; E04B 2001/8423; E04B 2001/8452; E04B 1/8218; E04B 1/8227; E04B 1/84; F04D 29/663; F04D 29/664
USPC ..... 181/200, 202, 205
See application file for complete search history.

(56) References Cited

U.S. PATENT DOCUMENTS 3,762,489 A * 10/1973 Proksch ..... B60R 13/0838 181/204
7,467,687 B2 * 12/2008 Mitchell ..... F02K 1/827 181/290
8,418,807 B1 * 4/2013 Nevins ..... F24F 13/24 52/145
10,741,158 B1 * 8/2020 Aune ..... G10K 11/162
2010/0212997 A1 * 8/2010 Cho ..... F01P 11/12 181/200
2019/0295520 A1 * 9/2019 Johnson ..... B32B 27/36

OTHER PUBLICATIONS

Rockwool® Multipurpose Board Insulation, Rockboard® 40/60/80, Premium Multipurpose Board Insulation for Acoustic/Therman Applications (6 pages).
Rockwool Rockboard® 80 Multipurpose Board Insulation, Technical Data Sheet, Board Insulation 07210, Board Insulation 07 21 13, Acoustic Board Insulation 09 81 13, Issued Jan. 1, 2018 (2 pages).

* cited by examiner

*Primary Examiner* — Jeremy A Luks
(74) *Attorney, Agent, or Firm* — Conley Rose, P.C.

(57) ABSTRACT

Embodiments disclosed herein include a sound attenuating enclosure defining an interior space, formed by a plurality of composite panels. In some embodiments the composite panels include a frame having a plurality of elongate frame members coupled to one another. The frame defines an inner side facing toward the interior space and an outer side facing away from the interior space. Additionally, some embodiments may include an outer skin secured to the outer side of the frame, an inner skin secured to the inner side of the frame, and a foam layer disposed between the outer skin and the inner skin and between at least a pair of the frame members.

21 Claims, 8 Drawing Sheets

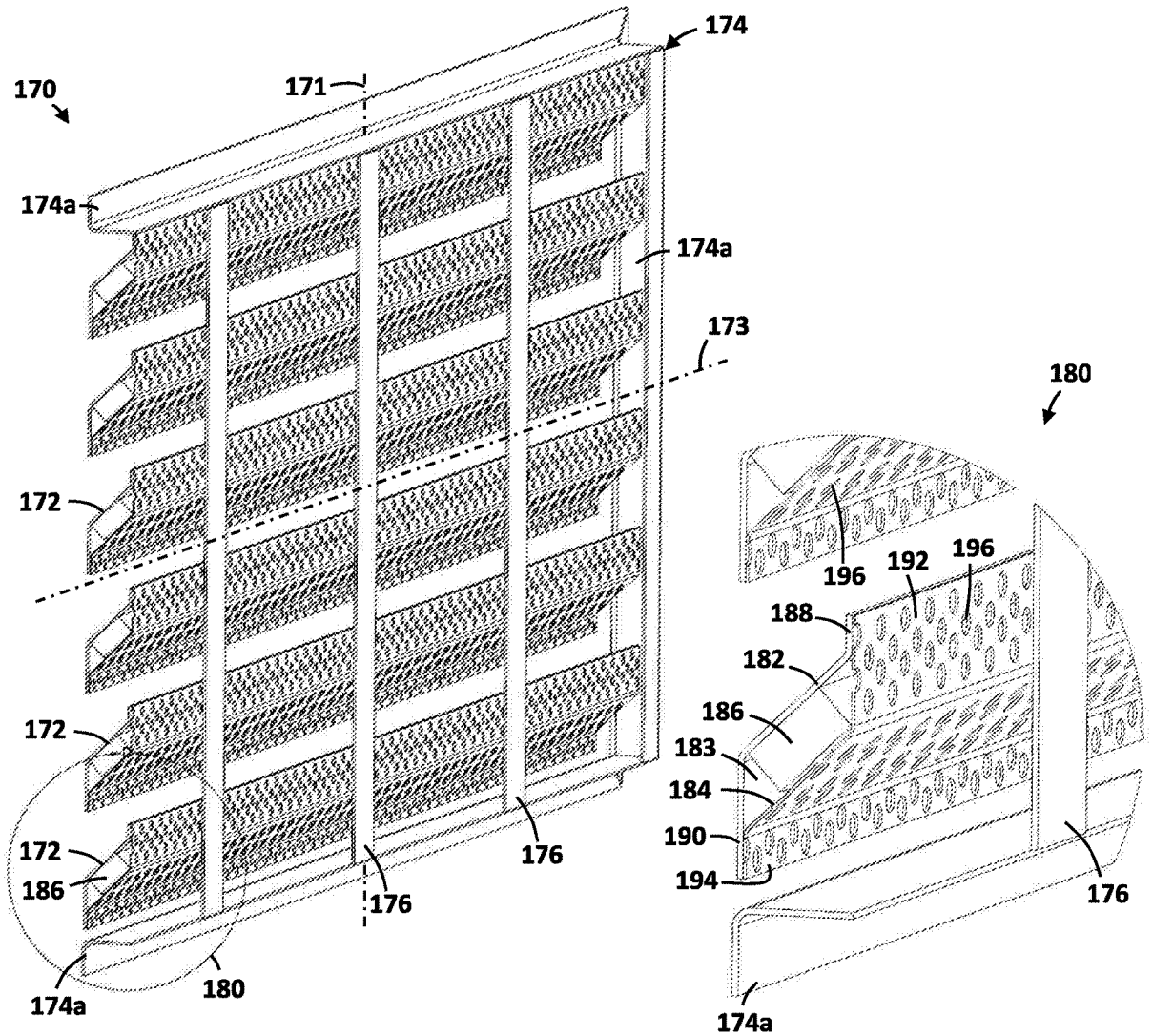
FIG. 8
FIG. 7
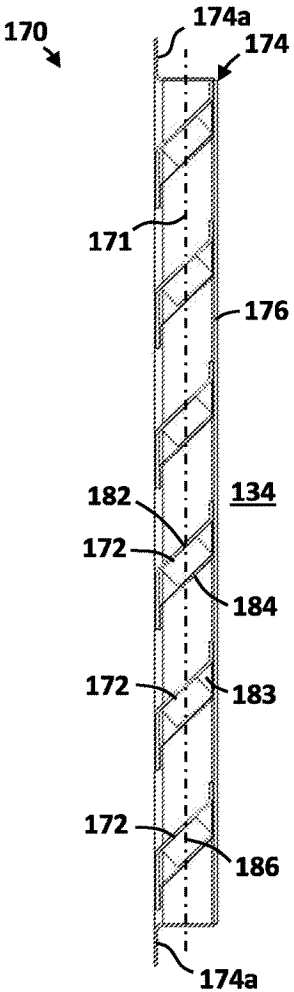
FIG. 6

SYSTEMS AND METHODS FOR ATTENUATING SOUND

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Mechanical equipment, such as equipment associated with oil and gas drilling, completion, and/or production operations, may emit a high amount of sound during operations. For example, the systems and machinery associated with hydraulic fracturing (e.g., pumps, motors, mixing units, etc.) may emit large amounts of sound. In some cases, this emitted sound may exceed limits (e.g., regulatory limits) for a particular site (e.g., such as an oil and gas well location), may pose a safety risk for site personnel, pedestrians, or local wildlife, and/or may simply be a nuisance to the local community.

BRIEF SUMMARY

Embodiments disclosed herein include a sound attenuating enclosure defining an interior space, formed by a plurality of composite panels. In some embodiments the composite panels include a frame having a plurality of elongate frame members coupled to one another. The frame defines an inner side facing toward the interior space and an outer side facing away from the interior space. Additionally, some embodiments may include an outer skin secured to the outer side of the frame, an inner skin secured to the inner side of the frame, and a foam layer disposed between the outer skin and the inner skin and between at least a pair of the frame members.

Other embodiments disclosed herein are directed to a system, including a platform, a sound attenuating enclosure disposed on the platform that defines an interior space, and a fluid flow inducing device disposed on the platform within the interior space. In an embodiment the sound attenuating enclosure includes a frame having a plurality of elongate frame members coupled to one another. Additionally, the frame defines an inner side facing toward the interior space and an outer side facing away from the interior space. Additionally, some embodiments may include an outer skin secured to the outer side of the frame, an inner skin secured to the inner side of the frame, and a foam layer disposed between the outer skin and the inner skin and between at least a pair of the frame members.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which:

FIG. 6 is a side view of a louver assembly for use within the sound attenuating enclosure of FIG. 2;

FIG. 7 is an isometric view of the louver assembly of FIG. 6;

FIG. 8 is a detailed isometric view of the section 180 of FIG. 7;

DETAILED DESCRIPTION

Figure 1:
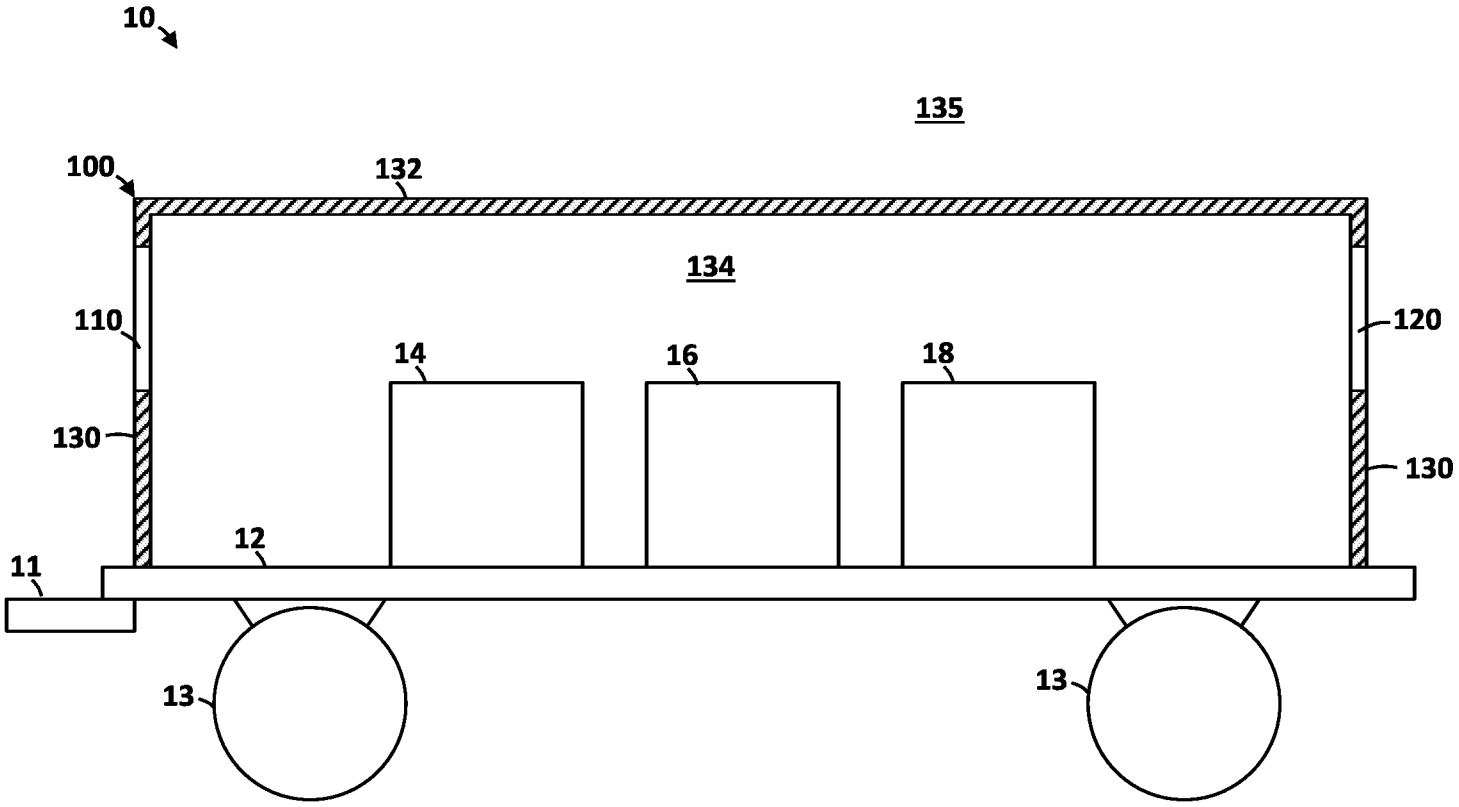
FIG. 1 is a cross-sectional schematic view of a system for attenuating sound, according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As previously described, mechanical equipment (such as equipment associated with well site operations of an oil and gas well) may emit large amounts of sound during operations. In addition, in the context of oil and gas operations, such sound emitting equipment (e.g., such as the pumps, blender units, and ancillary equipment associated with a hydraulic fracturing operation) may be transported and supported on truck-pulled trailers. Accordingly, embodiments described herein include enclosures that surround sound emitting equipment and attenuate some or all of the emitted sound during operations. In addition, some embodiments disclosed herein include enclosures that may be configured to surround trailer-mounted equipment, and as a result, the dimensions and weight of at least some of the disclosed enclosures may be set so as to facilitate their installation and use on such trailers during transportation thereof (e.g., such as on public roads and highways). Further details and features of the disclosed enclosures are now discussed in more detail below.

Referring now to FIG. 1, an embodiment of a system 10 for attenuating sound emitted from mechanical equipment or components 14, 16, 18 is shown. More particularly, system 10 comprises a sound attenuating enclosure 100 (or more simply "enclosure 100") coupled to a base or platform 12. Together the enclosure 100 and platform 12 define an interior space 134 that is separated from an outer environment 135 surrounding system 10. Sound producing components 14, 16, and 18 are disposed on platform 12, within enclosure 100 (and thus within interior space 134). Thus, generally speaking, during operations, sound that is emitted from components 14, 16, 18 is attenuated (e.g., partially, wholly, etc.) by enclosure 100 such that excessive sound is not emitted into the outer environment 135.

Platform 12 may be any supporting structure such as for example a welded frame, an equipment skid, a trailer, a concrete slab, the ground, etc. In some embodiments (e.g., such as the embodiment FIG. 1), platform 12 may comprise a truck-pulled trailer. Thus, in this embodiment, platform 12 further includes a hitch 11, which may be engaged with a suitable connector on a suitable vehicle (e.g., a semi-truck), and a plurality of wheels 13.

Enclosure 100 comprises a plurality of walls 130 and a ceiling or roof 132. A plurality of apertures or openings may extend through the walls 130 and/or ceiling 132 so as to provide access (e.g., for personnel, airflow, etc.) into interior space 134. For instance, in this embodiment, enclosure 100 includes a pair of apertures—Specifically an inlet or intake 110 and an outlet 120. During operations heat and/or exhaust generated by one or more of components 14, 16, and 18 may be transferred from interior space 134 via the intake 110 and outlet 120. While the intake 110 and outlet 120 extend through walls 130 of enclosure 100, it should be appreciated that one or both of the inlet 110 and outlet 120 may extend through ceiling 132 or even platform 12 in other embodiments. In addition, while only one intake 110 and one outlet 120 are shown in FIG. 1, it should be appreciated that in other embodiments a plurality of intakes 110 and/or a plurality of outlets 120 may extend through enclosure 100.

Sound producing components 14, 16, 18 may comprise any piece or assembly of sound producing equipment. For instance, sound producing components 14, 16, 18 may comprise any suitable component utilized in well site operation of an oil and gas well (e.g., such as a hydraulic fracturing operation). For instance, in some embodiments, components 14, 16, 18 may comprise pumps, compressors, engines, gear boxes, blenders, chemical additive units, hydrator units, hydraulic outdrive systems, exhaust outlets, air intakes, etc. No limitation is placed on the types, number, or arrangement of components 14, 16, 18, and the specific examples above are merely some of the types of equipment that may be placed within enclosure 100 during operations.

Figure 2:
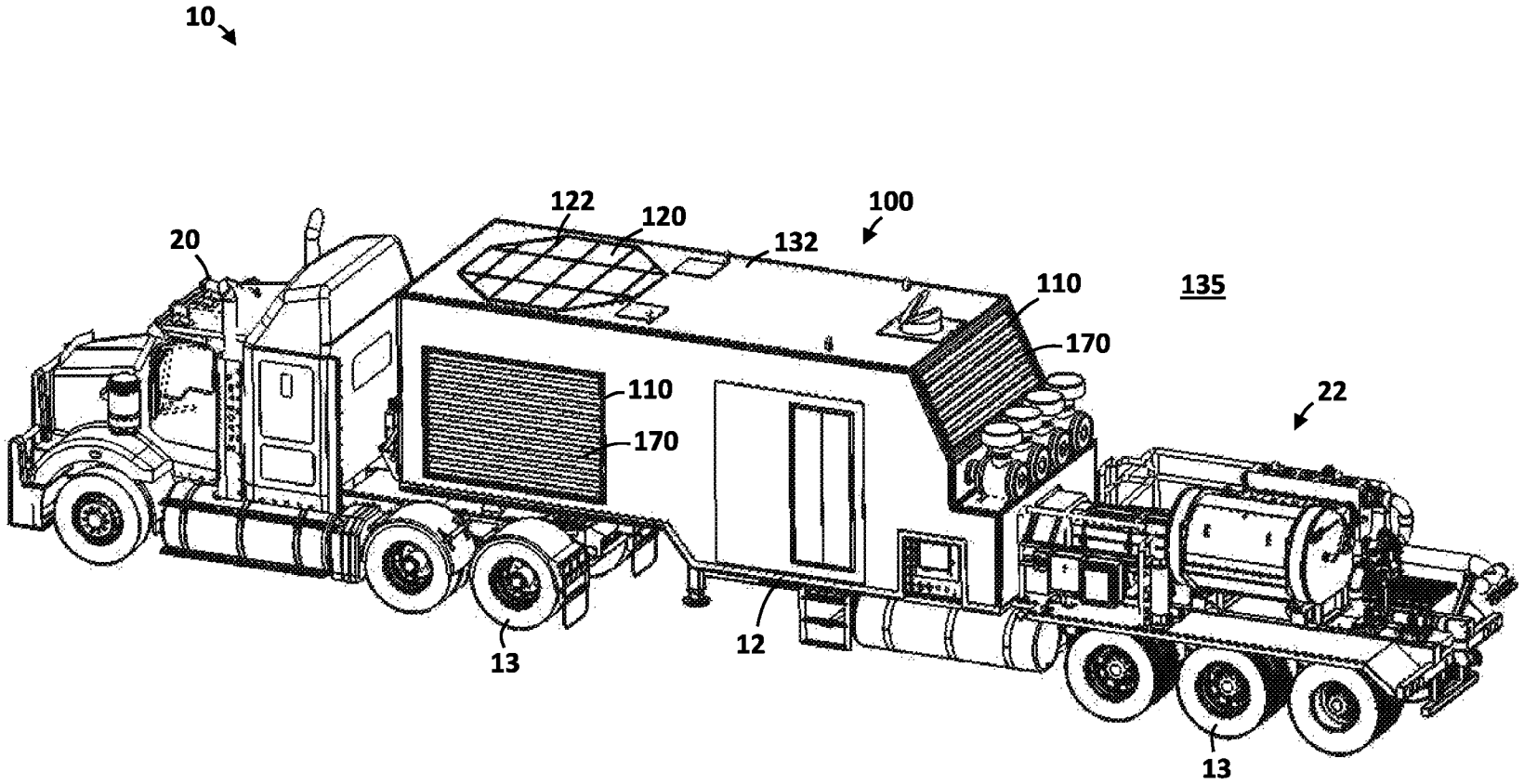
FIG. 2 is an isometric view of the system of FIG. 1, according to some embodiments.
Figure 3:
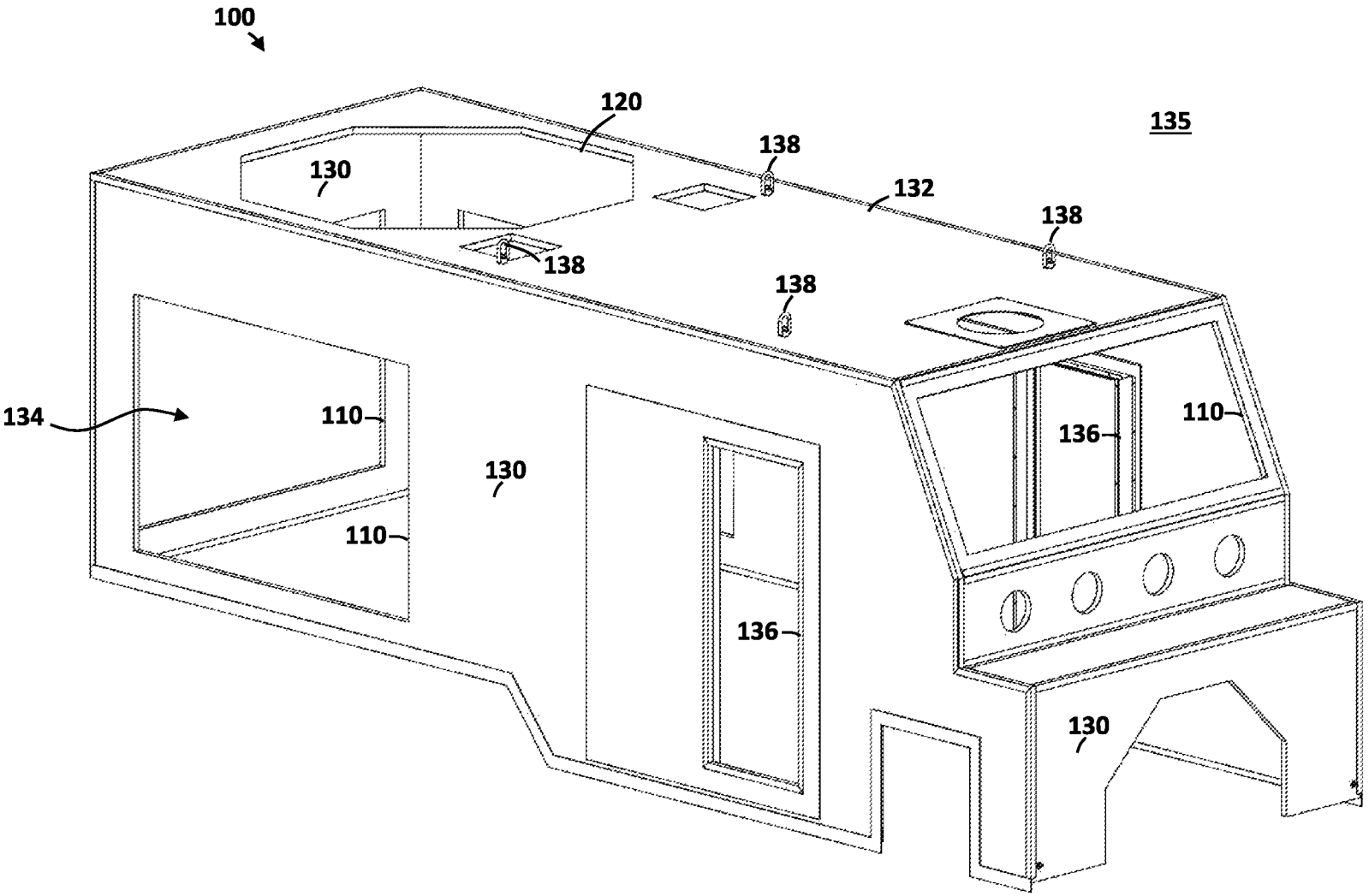
FIG. 3 is an isometric view of a sound attenuating enclosure of the system of FIG. 2.

Referring to FIGS. 2 and 3, a specific embodiment of system 10 is shown wherein platform 12 comprises a trailer which is transportable with a truck 20 (or other suitable vehicle). In this embodiment, a total of four intakes 110 are distributed along the walls 130 of sound attenuating enclosure 100 (two are visible in FIG. 2), while one outlet 120 is provided on ceiling 132. A grate 122 (e.g., expanded metal grating) may be used to cover outlet 120 to prevent physical contact with an air circulation fan (not shown) disposed within or adjacent outlet 120, which may be used to induce air flow between intake 110 and outlet 120, thus enhancing the heat transfer rate between sound generating components (e.g., components 14, 16, 18 shown in FIG. 1) and the outside environment 135. Additionally, a plurality of louver assemblies 170 are shown mounted within intakes 110, which as will be discussed more fully below, may attenuate sound attempting to exit intakes 110 during operations.

As shown in FIG. 2, some components or equipment (generally designated with reference numeral 22) supported on platform 12 are disposed outside of enclosure 100. These components 22 may include components that generate a relatively low amount of sound and/or components that may not otherwise be installed within enclosure (e.g., due to size, heat transfer requirements, connections to other components, etc.), and may include any suitable mechanical component (e.g., such as those described above).

Referring specifically to FIG. 3, in this embodiment the walls 130 and ceiling 132 of enclosure are connected edge-to-edge, so that enclosure 100 is generally shaped as a generally rectangular cuboid. The dimensions of walls 130 and ceiling 132 may be configured to provide suitable clearance for equipment disposed within enclosure 100 (e.g., such as components 14, 16, 18 shown in FIG. 1). Ceiling 132 comprises a plurality of lifting points 138 which may be used to lift sound attenuating enclosure 100 from platform 12, such as, for example during assembly (or disassembly) of system 10 and/or for maintenance, installation, and/or removal of components 14, 16, 18. In some embodiments, walls 130 may each comprise intake 110 and in some instances may include additional passages. For instance, as shown in FIG. 3, one of the walls 130 include a door 136 that may be used to provide access for personnel to the interior space 134 during operations.

In addition the orientation of walls 130 and/or ceiling 132 may be varied. For instance, in some embodiments the orientation of the walls 130 and/or ceiling 132 are selected to direct sound emissions along particular directions, or to provide clearance for components disposed in the interior space 134 (e.g., components 14, 16, 18 shown in FIG. 1). In some embodiments, intakes 110 and/or outlet 120 may be configured to point upwards relative to horizontal, as upward oriented passages may tend to direct sound in a generally upward direction. More particularly, upward oriented intakes 110 and/or outlets 120 may be beneficial because any sound exiting may be directed towards the sky and thus away from personnel or other individuals adjacent or proximate to system 10. As illustrated in the embodiment of FIGS. 2 and 3, one intake 110 and one outlet 120 are oriented upward (at least partially upward), however other embodiments may include more or less intakes 110 and outlets 120 which are oriented upward.

Figure 4:
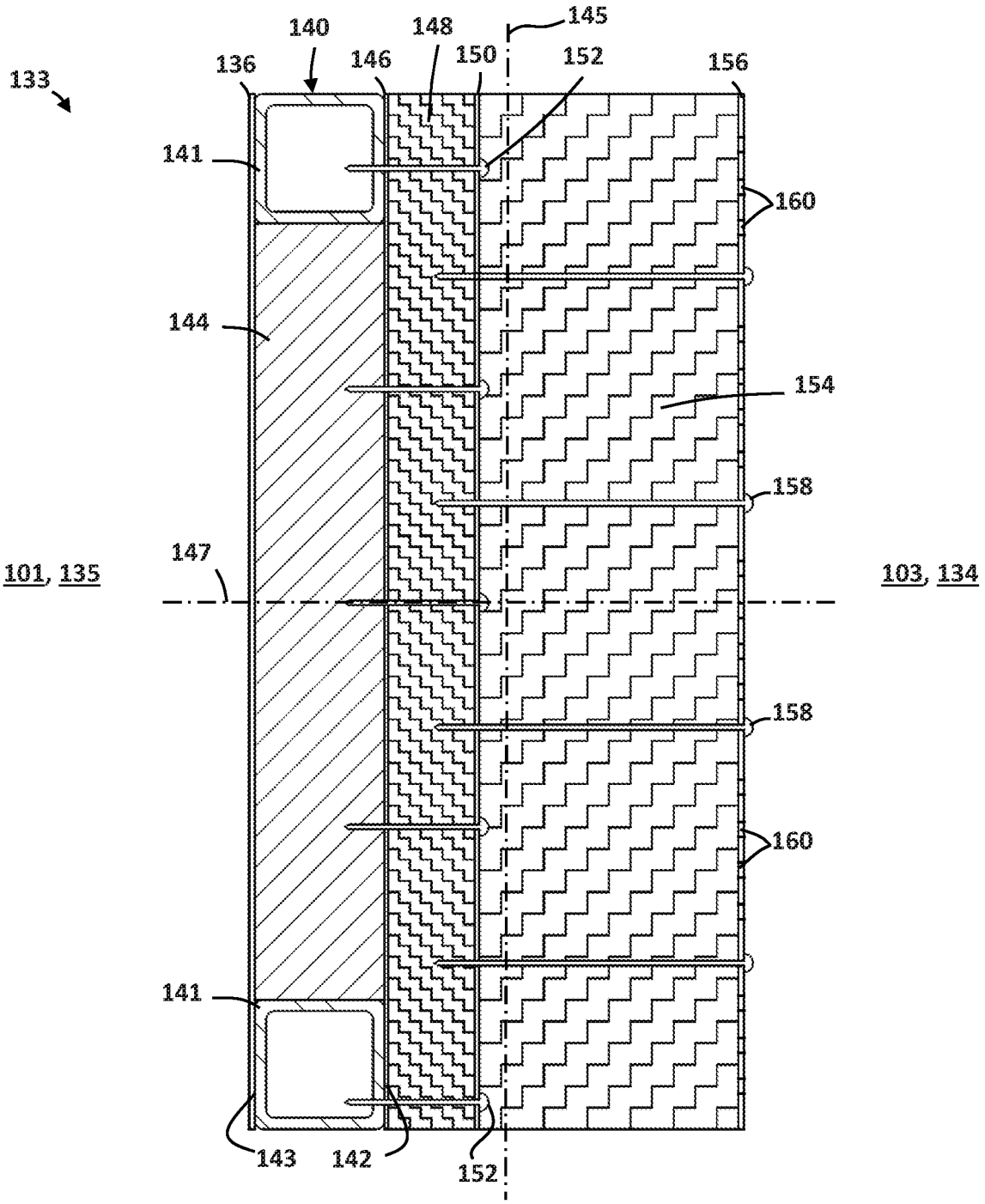
FIG. 4 is a cross-sectional view of a composite panel for use within the sound attenuating enclosure of FIG. 2, according to some embodiments.

Referring to FIG. 4, in some embodiments walls 130 and/or ceiling 132 of enclosure 100 (see e.g., FIGS. 1-3), may comprise composite panels including multiple layers of materials to attenuate sound during operations. An example section of a composite panel 133 that may form one or more (or all) of the walls 130 and/or ceiling 132 of enclosure 100 is shown. Panel 133 includes a first axis 145 and a second axis 147 that is orthogonal to the first axis 145. First axis 145 extends along or parallel to panel 133, while second axis 147 extends normally or perpendicularly through panel 133. A first or outer side 101 of panel 133 and a second or outer side 103 of panel 133 may oppose (e.g., radially oppose) one another across the first axis 145. When panel 133 is incorporated within the walls 130 and/or ceiling 132 of enclosure 100 of FIGS. 1-3, the first side 101 may be associated with the outer environment 135 and the second side 103 may be associated with the interior space 134.

Generally speaking, each composite panel 133 (regardless of whether it is included within the walls 130 or ceiling 132 of enclosure 100 in FIGS. 1-3) includes a plurality of layers. For instance, in some embodiments (e.g., such as the embodiment of FIG. 4, panel 133 comprises, moving axially from the outer side to the inner side 103 along second axis 147, a first or outer skin 136, a frame 140, a second or inner skin 146, a first insulation layer 148, a first isolating member 150, a second insulating member 154, and a second isolating member 156.

Frame 140 comprises a plurality of elongate frame members 141 coupled to one another, and each extending in a direction generally parallel to first axis 145. Frame 140 defines a first or inner side 142 that faces the interior space 134 and second side 103 (and thus faces away from the outer environment 101 and first side 101), and an outer side 143 that faces the outer environment 101 and first side 101 (and thus faces away from the interior space 134 and second side 103). Frame members 141 may comprise a rigid material, such as a metal, a composite (e.g., carbon fiber), a polymer, timber, or some combination thereof. In some embodiments, frame members 141 are hollow (or semi-hollow) such as shown in FIG. 4, so as to reduce the weight of enclosure 100. In some embodiments, frame members 141 may comprise aluminum tubing, such as, for instance square tubing as shown in FIG. 4.

Referring still to FIG. 4, outer skin 136 is secured to the outer side 143 of the frame 140, and inner skin 146 is secured to the inner side 142 of the frame 140. In some embodiments, skins 136, 146 may comprise a polymer, such as, for instance a fiberglass reinforced polymer. In some embodiments, skins 136, 146 may comprise "Filon G-III FRP" or "Noble Select D85" both available from CRANE® Composites, and/or "AZDEL™" available from Hanwha Azdel Corporation. In some embodiments, skins 136, 146, may comprise the same material; however, in other embodiments skins 136, 146 may comprise different materials. (e.g., such as aluminum or steel sheet).

In addition, in some embodiments (e.g., such as the embodiment of FIG. 4) a foam layer 144 is disposed between outer skin 136 and inner skin 146 and interspersed within the gaps formed between frame members 141. Foam layer 144 may comprise any suitable foam material such as, for instance, polystyrene foam. However, other types or combinations of foams and materials are contemplated herein (e.g., such as PVC structural foam, polyurethane foam (such as "Bluewater Panels" available from Coosa Composites), honeycomb core panels (such as "Plascore®" available from Plascore, Inc.), thermoplastic polymer, balsa wood, or wood).

As previously described composite panel 133 may comprise first insulation layer 148 coupled to inner skin 146 and first isolating member 150 coupled to first insulation layer 148 (e.g., such that first insulation layer 148 is between inner skin 146 and first isolating member 150 along an axial direction with respect to second axis 147). In some embodiments, an adhesive is used to secure inner skin 146, first insulation layer 148, and first isolating member 150 to each other and also to frame 140. In other embodiments (e.g., such as the embodiment of FIG. 4) a plurality of first attachment members 152 are used to secure inner skin 146, first insulation layer 148, and first isolating member 150 to each other and also to frame 140 either in addition to or in lieu of adhesive. More particularly, the first attachment members 152 may traverse generally axially along axis 147 (and thus in a radially with respect to first axis 145) through first isolating member 150, first insulating member 148, inner skin 146, and into foam layer 144 or frame members 141 (depending the specific position of first attachment members 152 along panel 133). In some embodiments, first attachment members 152 may not extend through to the foam layer 144 and frame members 141.

In addition, as previously described composite panel 133 may further comprise second insulation layer 154 coupled between first isolating member 150 and second isolating member 156 (e.g., such that the second insulation layer 154 is between first isolating member 150 and second isolating member 154 along an axial direction with respect to second axis 147). Generally speaking, the second insulation member 154 is the same or similar to the first insulation member 148; however, in some embodiments, the thickness of second insulation member 154 may be greater than a thickness of first insulation member 148 (e.g., in the embodiment of FIG. 4, second insulation member 154 is thicker than first insulation member 148). In addition, the second isolating member 156 may be generally the same or similar to first isolating member 150, except that in some embodiments (e.g., such as the embodiment of FIG. 4) the second isolating member 156 may include a plurality of perforations 160 passing therethrough, thereby exposing second insulation layer 154 to interior space 134 via the perforations 160.

First isolating member 150, second insulation layer 154, and second isolating member 156 may be attached to each other using an adhesive, and/or a plurality of second attachment members 158. More particularly, the second attachment members 158 may traverse axially along second axis 147 (and thus in a radially with respect to first axis 145) through second isolating member 156, second insulating member 154, first isolating member 150, and into first insulation layer 148.

The first attachment members 152 and the second attachment members 158 may comprise any suitable elongate member or device for attaching tow components to one another. For instance, in some embodiments, the attachment members 152, 158 may comprise screws, nails, bolts, pegs, pins, or any combination thereof. In some embodiments, first attachment members 152 and second attachment members 158 may comprise a rigid material (e.g., such as a metal in some embodiments). When both first attachment members 152 and second attachment members 158 are used to secure various layers of panel 133 together (e.g., frame 140, second or inner skin 146, first insulation layer 148, first isolating member 150, second insulating member 154, and second isolating member 156, etc.), the arrangement of attachment members 152, 158 may be offset, such that each first attachment member 152 is not aligned with any of the second attachment members 158. In other words, each of the first attachment members 152 is radially misaligned with each of the second attachment members 158 with respect to second axis 145. Accordingly, in these embodiments first attachment members 152 are not in direct contact with second attachment members 158. Without being limited to this or any other theory, by misaligning the attachment members 152, 158 in the manner described above and shown in FIG. 4, vibrations caused by the sound emitted within interior space 134 may be directly conducted or transferred between the attachment members 152, 158 during operations.

The first insulation layer 148 and second insulation layer 154 may comprise acoustically insulating materials. For instance, in some embodiments, first insulation layer 148 and second insulation layer 154 may comprise an acoustic board insulation such ROCKBOARD® (e.g., ROCKBOARD® 80) available from ROCKWOOL™. In other embodiments, a loose fill type acoustic insulation may be utilized within (e.g., either alone or in combination with other insulating materials such those described above) within one or both of the first insulation layer 148 and the second insulation layer 154. Additionally, in some embodiments the materials making up the first insulation layer 148 and the second insulation layer 154 may be the same; however, in other embodiments, the materials making up the insulation layers 148, 154 may be different.

Referring still to FIG. 4, during operations sound waves (e.g., such as those generated by components 14, 16, 18 shown in FIG. 1) may impact the inner side 103 of panel 133 and panel 133 may attenuate some or all of the sound energy such that none or a reduced amount of sound is emitted to the second side 101. More particularly, sound from within interior space 134 first acts upon second isolating member 156, partially passing therethrough via perforations 160. The sound energy is absorbed (e.g., partially) within second insulation layer 154. Residual sound not initially attenuated or absorbed within second insulation layer 154 may be reflected by first isolating member 150 back through second insulation layer 154 for further attenuation.

In some instances, some sound energy may pass through first isolating member 150 (instead of being reflected back into the second insulation layer 154 as previously described). However, any such sound that passes through first isolation member 150 may be further attenuated by first insulation layer 148. Similarly, if any secondary sound passes through first insulation layer 148 and inner skin 146, it may be further attenuated by foam layer 144.

In some instances, sound vibrations may also travel along first attachment members 152 and/or second attachment members 158. However, attachment members 152, 158 may be offset as previously described, such that in these embodiments no direct sound path is provided through insulation layers 148, 154 via aligned attachment members 152, 158. In some embodiments, attachment members 152, 158 may comprise polymeric materials, so as to impart sound damping properties thereto.

Accordingly, as described herein, panel 133 may receive sound energy via perforations 160 in second isolation member 156 and then may damp or attenuate the sound (or vibrations) via insulation layers 148, 154 as previously described above. As a result, panels 133 may reduce or attenuate any sound that may attempt to pass therethrough during operations.

Figure 5:
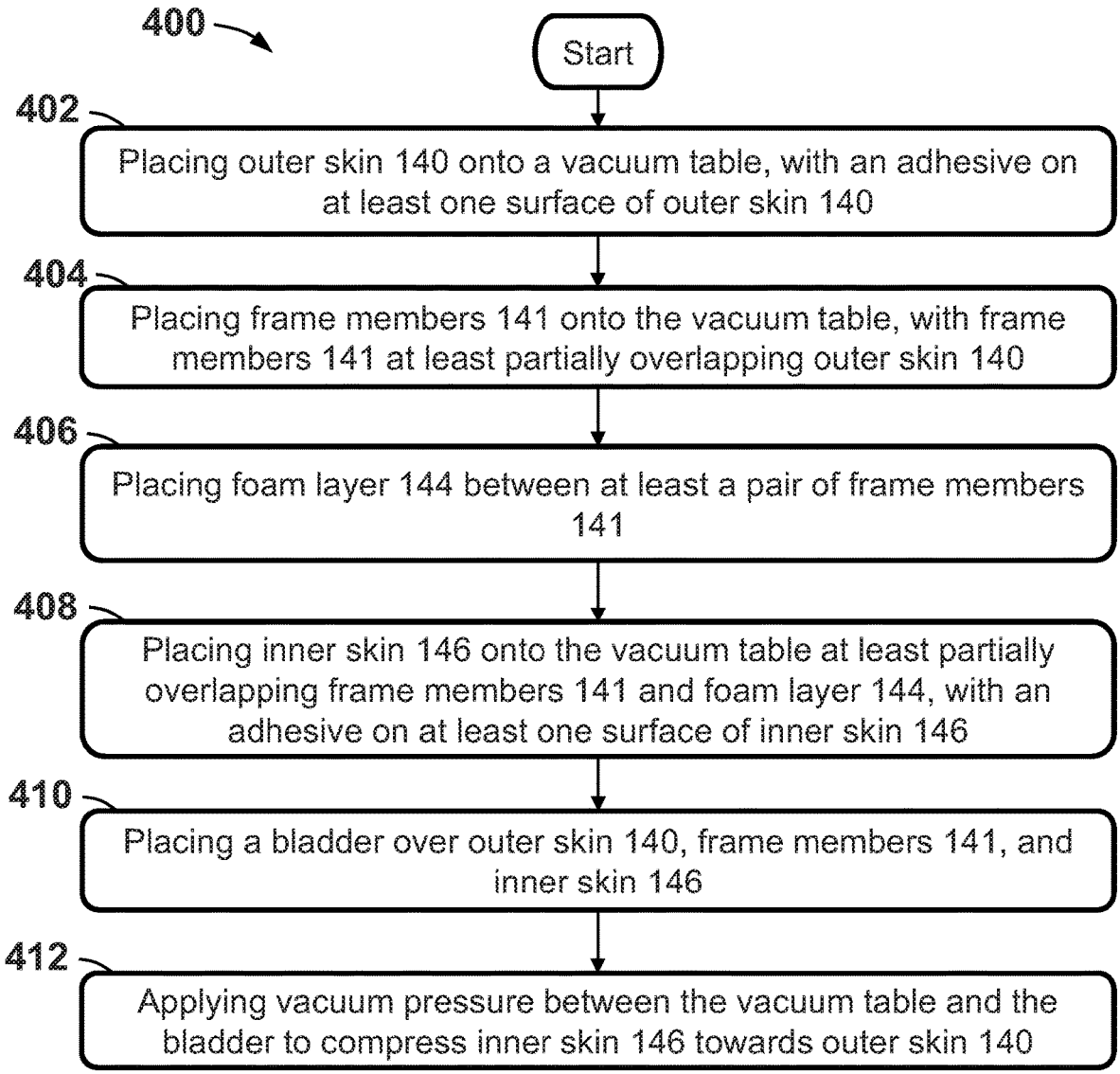
FIG. 5 is a method of forming composite panels for use within the sound attenuating enclosures of FIGS. 2, 3, and 12, according to some embodiments.

In some embodiments the composite panel 133 of FIG. 4 (e.g., which may form walls 130 and/or ceiling 132 of sound attenuating enclosures 100 as previously described), may be formed using a vacuum molding process. Method 400 shown in FIG. 5 comprises one example of such a vacuum molding process for forming composite panels 133. Thus, in describing the features of method 400, continuing reference is made to the panel 133 shown in FIG. 4. However, it should be appreciated that other methods may be used to form panels 133 other than the vacuum molding process of method 400. For instance in some embodiments, pressure bonding may be utilized, wherein panels 133 are mechanically compressed as adhesive bonds the comprising layers (e.g., such as outer skin 136, frame 140, and inner skin 146, alternatively referred to herein as "layers"). In addition, during this process no external compression may be applied and gravity may be used to maintain layer contact during adhesive curing. Still further, additional mechanical fasteners (e.g., such as screws or bolts) may be used to compress the layers during adhesive curing, which may be optionally removed after adhesive curing. It is contemplated that any type of adhesive may be used to bond the layers. (e.g., such as contact adhesive, resins, fiberglass resin, epoxy, hot melt, acrylic, urethane, or pressure activated adhesive).

Initially method 400 comprises, in block 402, placing the outer skin 136 onto a vacuum table, with an adhesive on at least one surface of outer skin 136. Next, method 400 comprises, in block 404, placing the frame members 141 of frame 140 onto the vacuum table, with frame members 141 at least partially overlapping outer skin 140 along outer side 143. Specifically, at 404, the frame member 141 may be placed on the side of outer skin 136 that includes the previously applied adhesive. The method 400 further comprises, in block 406, placing foam layer 144 between at least a pair of frame members 141. Specifically, the foam layer 144 may be disposed between some of the frame members 141 or in substantially all of the spaces or openings defined between frame members 141. The method 400 further comprises, in block 408, placing inner skin 146 onto the vacuum table at least partially overlapping frame members 141 along inner side 142 and foam layer 144 (e.g., on a side of the frame 140 that is opposite first skin 136 such as shown in FIG. 4), with an adhesive on at least one surface of inner skin 146. Method 400 further comprises, in block 410, placing a bladder or other cover over the stacked outer skin 136, frame members 141, and inner skin 146. Finally, method 400 further comprises, in block 412, applying vacuum pressure between the vacuum table and the bladder to compress inner skin 146 towards outer skin 136.

Referring again to FIG. 2, as previously described, louver assemblies 170 may be mounted within intakes 110 of sound attenuating enclosure 100, which may attenuate sound attempting to exit intakes 110 during operations. Referring to FIGS. 6-8, louver assembly 170 comprises a frame 174 and a plurality of louvers 172 extending parallel to one another and spaced apart within the frame 174.

In this embodiment Frame 174 is constructed in a rectangular configuration (although other shapes are possible) including a first axis 171 and a second axis 173 orthogonal to the first axis 171. In particular, frame 174 is constructed from a plurality (specifically four in this embodiment) straight segments **174*a*, each having an "L" cross-section (e.g., extruded angle), and each coupled end-to-end. As shown, one of the four straight segments 174*a* of louver frame 174 has been omitted in FIGS. 6-8 to better show the orientation and composition of the plurality of louvers 172, which are described in more detail below. A plurality of straps 176, extend axially along first axis 171 between opposing sides of louver frame 174. In addition, straps 176 are oriented approximately perpendicular to the plurality of louvers 172, and may couple with the plurality of louvers 172 to maintain the spacing therebetween along first axis 171**.

Louvers 172 extend between opposing segments 174*a* in a direction that is parallel to axis 173. In addition, louvers 172 are spaced from one another along axis 171. As best shown in FIG. 8, each of the plurality of louvers 172 comprises a first or outer side 182 and a second or inner side 184 spaced apart from outer side 182. Generally speaking, outer side 182 and inner side 184 are each bent such that a cavity 183 is formed therebetween, which in some embodiments may be partially or totally filled with insulation 186. More particularly, outer side 182 is bent in two locations to form top flange 188 and bottom flange 190 which is opposite top flange 188. Additionally, inner side 184 is also bent in two locations to form top flange 192 and bottom flange 194 which is opposite top flange 192.

The flanges 188, 190 of outer side 182 may be substantially parallel with one another, and the flanges 192, 194 of the inner side 184 may be substantially parallel with one another. Inner side 184 further includes a plurality of perforations 196, which in this embodiment comprise cylindrical holes, passing into cavity 183. Top flanges 188, 192 of sides 182, 184 are engaged with and secured to one another, and bottom flanges 190, 194 of sides 182, 184, respectively are engaged with and secured to one another so as to define the cavity 183. Insulation 186 is captured within cavity 183 between outer side 182 and inner side 184. In some embodiments, insulation 186 may comprise acoustic board insulation such as commercially available ROCKBOARD® 80 from ROCKWOOL™, and/or may comprise alternative types of acoustic materials such as loose fill insulation.

As best shown in FIG. 6, adjacent louvers 172 may be spaced, such that top flanges 188, 192 of each louver 172 overlap with the bottom flanges 190, 194 of an immediately adjacent louver 172 in an axial direction with respect to first axis 171. Alternatively, adjacent louvers 172 may be spaced such that the above described overlap between adjacent flanges 188, 192 and 190, 94 does not occur. Overall, the spacing between adjacent louver bodies 172 may be adjusted or "tuned" to provide effective sound attenuation while also maximizing the air flow area between adjacent louver bodies 172 and hence through louver assembly 170.

Referring again to FIG. 2, louver assembly 170 may be secured within intakes 110 of sound attenuating enclosure 100 to attenuate sound generated therein, while still allowing airflow therethrough, and thus providing a fluid communication path between interior space 134 of sound attenuating enclosure 100 (see e.g., FIG. 1) and the ambient air surrounding sound attenuating enclosure 100. Louver assemblies 170 may each be produced having different geometries and may be installed along sound attenuating enclosure 100 in multiple locations.

Referring again to FIGS. 6, 7, and 8, sound waves (e.g., such as those generated by components 14, 16, 18 shown in FIG. 1) may impact louver assembly 170 along inner sides 184 of louvers 172. As a result, the sound may pass through perforations 196 into cavities 183 and be absorbed (at least partially) by insulation 186. Any residual sound not initially attenuated by insulation 186 may be reflected by outer side 182 back through insulation 186 for further attenuation. The spacing between adjacent louvers 172, and hence the degree of potential overlap between top flanges 188, 192, and bottom flanges 190, 194 of adjacent louvers 172 may prevent sound from passing between adjacent louvers 172 during operations. As a result, in these embodiments, most or all of the sound passing through louver assembly 170 is forced (at least partially) through one of the louvers 172 such that attenuation and damping may occur as described above.

Figure 11:
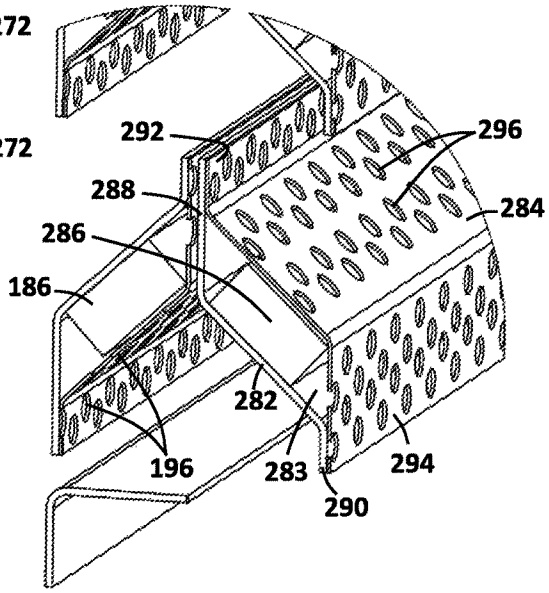
FIG. 11 is a detailed isometric view of the section 280 of FIG. 10.
Figure 10:
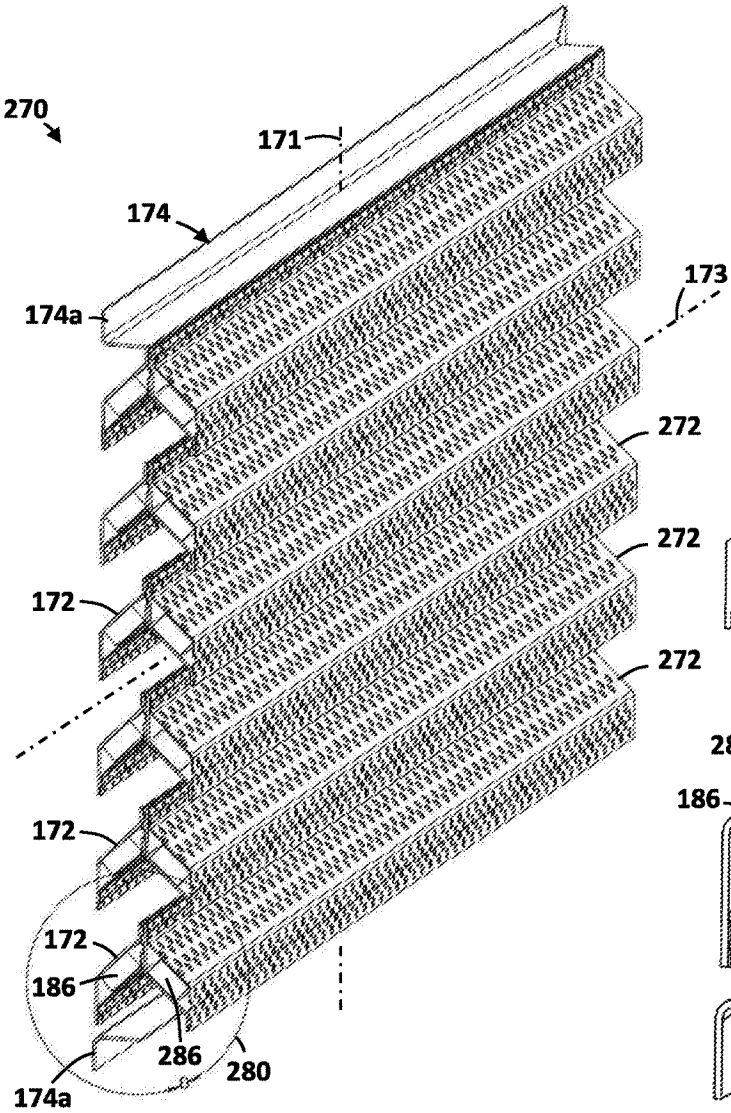
FIG. 10 is an isometric view of the louver assembly of FIG. 9.
Figure 9:
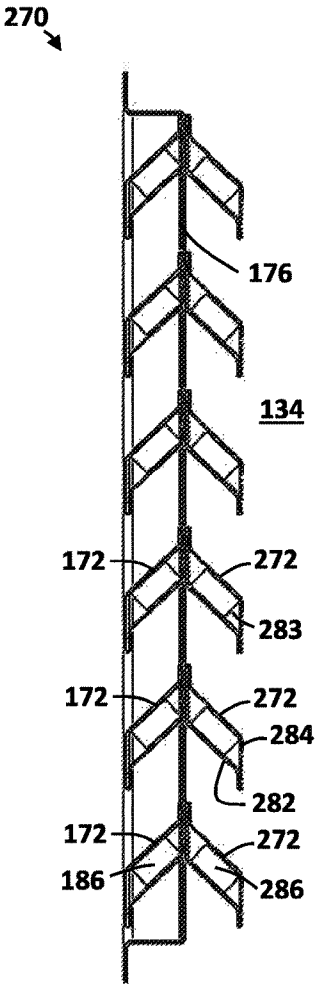
FIG. 9 is a side view of a louver assembly for use within the sound attenuating enclosure of FIG. 2, according to some embodiments.

Referring to FIGS. 9, 10, and 11, another louver assembly 270 is illustrated that may be used within system 10 (e.g., within intakes 110 shown in FIG. 2) in place of some or all of louver assemblies 170, as previously described above. Generally speaking, louver assembly 270 is similar to louver assembly 170 previously described, and thus, components of louver assembly 270 that are shared with louver assembly 170 are identified with like reference numerals, and the description below will focus on features of louver assembly 270 that are different from louver assembly 170. In particular, louver assembly 270 further comprises a plurality of second louvers 272 which are coupled to strap 176 along a surface or side that is opposite the plurality of louvers 172 (which may be referred to as "first louvers 172"). In this manner, the plurality of second louvers 272 are each aligned with a corresponding one of first louvers 172, such that arrangement of the second louvers 272 mirrors the arrangement of the first louvers 172 across strap 176.

As best shown in FIG. 11, each of the plurality of louver bodies 272 comprise an outer side 282 and an inner side 284 spaced apart from outer side 282. Generally speaking, outer side 282 and inner side 284 are each bent such that a cavity 283 is formed therebetween, which in some embodiments may be filled with insulation 286. More particularly, outer side 282 is bent in two locations to form top flange 288 and bottom flange 290 which is opposite top flange 288. Additionally, inner side 284 is also bent in two locations to form top flange 292 and bottom flange 294 which is opposite top flange 292

The flanges 288, 290 of outer side 282 may be substantially parallel with one another, and the flanges 292, 294 of the inner side 284 may be substantially parallel with one another. Inner side 284 further includes a plurality of perforations 296 passing therethrough, which in this embodiment comprise cylindrical holes similar to perforations 196 previously described above. Top flanges 288, 292 of sides 282, 284 are engaged with and secured to one another, and bottom flanges 290, 294 of sides 282, 284, respectively are engaged with and secured to one another so as to define the cavity 283. Insulation 286 is captured within cavity 283 between outer side 282 and inner side 284. In some embodiments, insulation 286 may be substantially the same as insulation 186 within first louvers 172 such that the description above for insulation 186 may be applied to describe the insulation 286 within second louvers 272.

Generally speaking, louver assembly 270 operates similarly to louver assembly 170 as previously described, but may offer enhanced sound attenuation. More particularly, the sound attenuation performance may tend to increase with increasing volumes of sound attenuation insulation (e.g., such as insulation 186, 286), thus louver assembly 270 may attenuate sound more effectively than louver assembly 170. Additionally, the orientation of inner sides 184, 284 of louver bodies 172, 272, respectively, may further contribute to enhanced sound attenuation performance. More specifically, sound waves impacting inner sides 184, 284 at a normal direction (e.g. ninety degrees to inner sides 184, 284) may tend to be absorbed more readily by insulation 186, 286 as compared to being partially deflected. Accordingly, louver assembly 270 may also offer enhanced sound attenuation by virtue of the increased quantity of angled surfaces presented to the sound (e.g. inner side 184 of the plurality of louver bodies 172 and inner side 284 of the plurality of second louver bodies 272).

Figure 12:
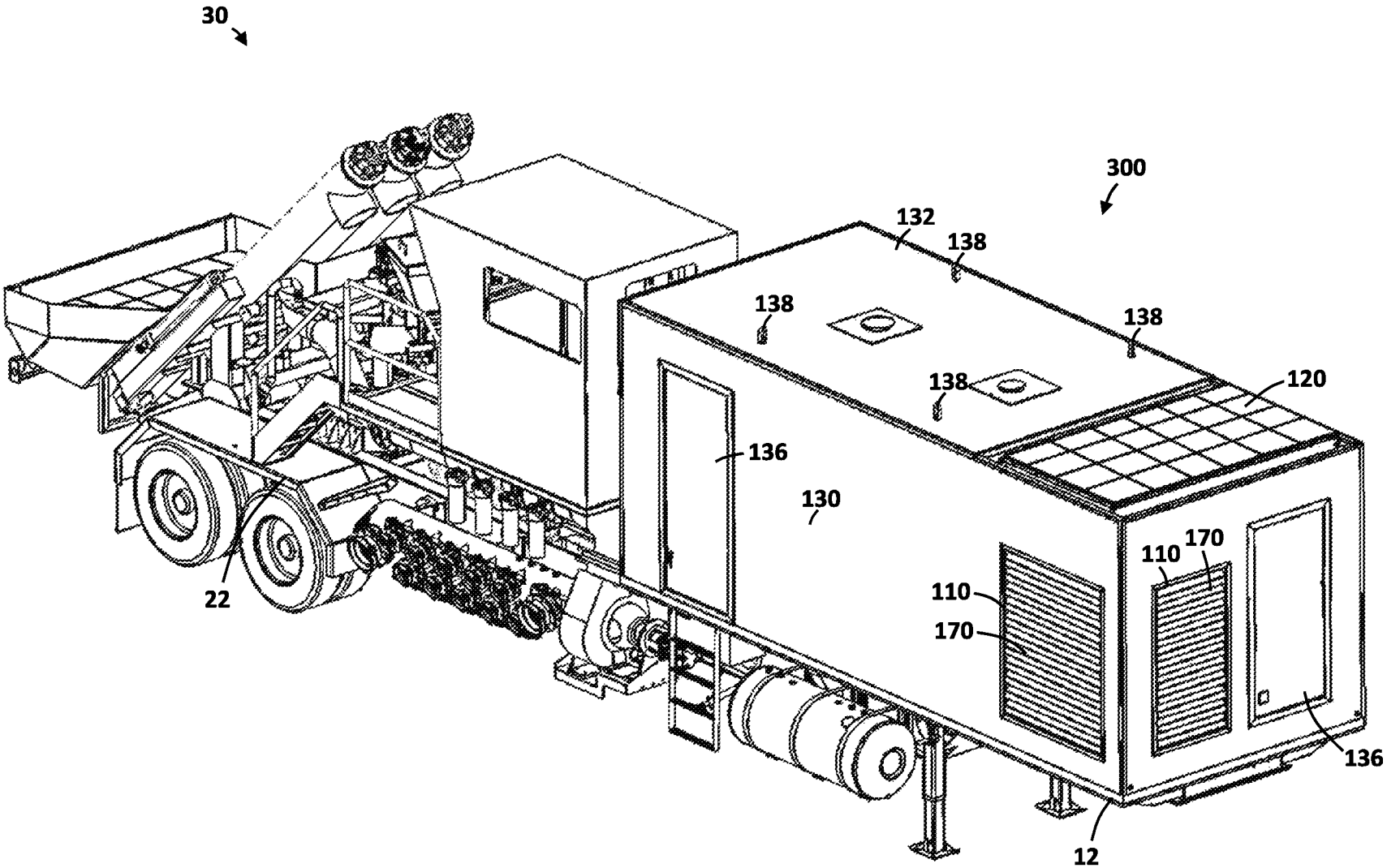
FIG. 12 is an isometric view of a system for attenuating sound according to some embodiments.

Referring to FIG. 12, another embodiment of a system 10 is shown as system 30 which includes sound attenuating enclosure 300. In some embodiments, sound attenuating enclosure 300 may be used for a blender system for mixing proppant (e.g., sand) within a fluid stream during hydraulic fracturing operations. Sound attenuating enclosure 300 is similar to sound attenuating enclosure 100 previously described, and thus includes a plurality of walls 130 and a ceiling 132 comprising composite panels 133 as previously describe above (see e.g., FIG. 4). However, size and shape of enclosure 300 may be different from that shown and described above for enclosure 100. In addition, enclosure 300 may include louver assemblies 170, and/or 270 (see e.g., FIGS. 6-11) as previously described. Additionally, sound attenuating enclosure 300 may comprise different quantities and arrangements of components, such as for example, intake 100 and doors 136. For example, in this embodiment, outlet 120 is shown with a rectangular profile.

In the manner described, embodiments disclosed herein include systems and methods for attenuating sound emitted by mechanical components (e.g., such components associated with a hydraulic fracturing or other oil and gas operation). Thus, the disclosed systems and methods may allow the use of sound producing equipment in areas having sound emission restrictions, such as those imposed for personnel safety, associated with wildlife protection areas, or city regulations. Additionally, some embodiments of the sound attenuating enclosures described herein may be produced (at least partially) out of composite and/or light weight materials, thus allowing for easier transport and removal during equipment maintenance.

In some embodiments, composite panels 133 of FIG. 4 may include more or less layers of isolating members 150, 156 and insulation layers 148, 154. Additionally, isolating members 150, 156 and insulation layers 148, 154 may be provided in different thicknesses relative to the thicknesses shown in the drawings. Further, perforations 160, 196, 296, as shown in FIGS. 4, 8, and 11, may be provided with any spacing, shape, or size. For example, it is anticipated that elliptical, rectangular, square, or any polygon may be readily used. Additionally, perforations 160, 196, 296 may be substituted using any passage which provides fluid communication therethrough. For example a suitable passage may be produced using narrow slits, which define regions therebetween, the regions then being raised and/or lowered in an alternating fashion, thus expanding the slits to form passages. Still further, it is anticipated that the spacing between the plurality of second louver bodies 272, as shown in FIG. 9, may be staggered relative to the spacing of the plurality of louver bodies 172 such that louver assembly 270 is not symmetric or mirrored across strap 176. Additionally, the bend angles of outer side 282 and inner side 284 of second louvers 272 may differ from the bend angles comprising outer side 182 and inner side 184 of louvers 172.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A sound attenuating enclosure defining an interior space, the sound attenuating enclosure comprising:
- a plurality of composite panels, wherein each of the plurality of composite panels comprises:
  - an axis extending perpendicularly through the composite panel;
  - a frame comprising a plurality of elongate frame members coupled to one another, wherein the frame defines a first side, and
  - a second side opposite the first side;
  - a first skin layer secured to the first side of the frame;
  - a second skin layer secured to the second side of the frame; and
  - a foam layer positioned axially between the first skin layer and the second skin layer along the axis and between at least a pair of the frame members;
- an opening configured to provide fluid communication between the interior space and an environment surrounding the enclosure; and
- a plurality of louvers extending across the opening, wherein each of the plurality of louvers comprises:
  - an internal cavity that is shaped as a parallelogram in cross-section;
  - a pair of planar, parallel flanges extending outward from opposite sides of the internal cavity; and
  - insulation positioned within the internal cavity.

2. The sound attenuating enclosure of claim 1, wherein the plurality of composite panels comprises four wall panels and a ceiling panel, wherein each of the wall panels abuts with two adjacent wall panels and the ceiling panel abuts with each of the wall panels.

3. The sound attenuating enclosure of claim 1, wherein the first skin layer and the second skin layer comprise fiberglass reinforced polymer skin.

4. The sound attenuating enclosure of claim 1, wherein the plurality of elongate frame members comprises rigid tubing.

5. The sound attenuating enclosure of claim 4, wherein the rigid tubing comprises aluminum tubing.

6. The sound attenuating enclosure of claim 1, wherein each of the plurality of louvers comprises a plurality of perforations extending into the internal cavity.

7. The sound attenuating enclosure of claim 1, wherein each of the plurality of composite panels further comprises a first insulation layer coupled to the second skin layer, wherein the first insulation layer comprises a first surface and a second surface opposite the first surface of the first insulation layer.

8. The sound attenuating enclosure of claim 7, wherein each of the plurality of composite panels further comprises a first isolating member coupled to the second surface of the first insulation layer.

9. The sound attenuating enclosure of claim 8, wherein each of the composite panels further comprises a second insulation layer coupled to the first isolating member, opposite the first insulation layer, wherein the second insulation layer comprises a first surface and second surface opposite the first surface of the second insulation layer.

10. The sound attenuating enclosure of claim 9, wherein each of the plurality of composite panels further comprises a second isolating member coupled to the second surface of the second insulation layer.

11. The sound attenuating enclosure of claim 10, wherein the second isolating member comprises a plurality of perforations extending therethrough.

12. The sound attenuating enclosure of claim 9, wherein each of the plurality of composite panels comprises:

a plurality of first attachment members, wherein each of the plurality of first attachment members has an end positioned along the first isolating member and a body extending from the end through the first isolating member, the first insulation layer, and the second skin layer; and a plurality of second attachment members, wherein each of the plurality of second attachment members extends through the second insulation layer and the first isolating member and terminates within the first insulation layer, wherein each of the first attachment members is radially offset from each of the second attachment members with respect to the axis.

13. A system, comprising:

a platform;

a sound attenuating enclosure disposed on the platform that defines an interior space, wherein the sound attenuating enclosure comprises a plurality of panels, and wherein each panel of the plurality of panels comprises:

an axis extending perpendicularly through the panel;

a frame comprising a plurality of elongate frame members coupled to one another;

a first skin layer and a second skin layer secured to axially opposite sides of the frame;

a foam layer disposed between at least a pair of the frame members and extending axially between the first skin layer and the second skin layer;

a first insulation layer coupled to the second skin layer;

a second insulation layer;

a first isolating member having a first side engaged with the first insulation layer and a second side opposite the first side that is engaged with the second insulation layer;

a plurality of first attachment members, wherein each of the plurality of first attachment members has an end positioned along the second side of the first isolating member and a body extending axially from the end through the first isolating member, the first insulating member, and the second skin layer; and a plurality of second attachment members, wherein each of the plurality of second attachment members extends through the second insulation layer and the first isolating member and terminates within the first insulation layer; wherein each of the plurality of first attachment members is radially offset from each of the plurality of second attachment members.

14. The system of claim 13, wherein the first skin layer and the second skin layer comprise fiberglass reinforced polymer skin.

15. The system of claim 13, wherein the second insulation layer comprises a first surface and a second surface opposite the first surface, wherein the first surface of the second insulation layer is coupled to the first side of the first isolating member; and wherein each panel of the plurality of panels further comprises a second isolating member coupled to the second surface of the second insulation layer.

16. The system of claim 15, wherein the second isolating member comprises a plurality of perforations extending therethrough.

17. The system of claim 15, wherein the plurality of first attachment members do not extend through the second insulation layer, and wherein the plurality of second attachment members do not extend through the first insulation layer.

18. The system of claim 15, wherein the platform is mounted to a trailer that is configured to be pulled by a truck.

19. The system of claim 15, wherein the sound attenuating enclosure comprises:

an opening configured to provide fluid communication between the interior space and an environment surrounding the enclosure; and a plurality of louvers extending across the opening, wherein each of the plurality of louvers comprises:

an internal cavity that is shaped as a parallelogram in cross-section;

a pair of planar, parallel flanges extending outward from opposite sides of the internal cavity; and insulation positioned within the internal cavity.

20. The system of claim 19, wherein each of the plurality of louvers comprises a plurality of perforations extending into the internal cavity.

21. The system of claim 20, wherein each of the plurality of louvers overlaps with another of the plurality of louvers across the opening.

* * * * *